US008899854B2

(12) United States Patent
Sakano et al.

(10) Patent No.: US 8,899,854 B2
(45) Date of Patent: Dec. 2, 2014

(54) TAPE PRINTER CONTROL METHOD AND TAPE PRINTER

(75) Inventors: Hideki Sakano, Matsumoto (JP); Hideo Sodeyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 184 days.

(21) Appl. No.: 13/529,091

(22) Filed: Jun. 21, 2012

(65) Prior Publication Data

US 2013/0004225 A1 Jan. 3, 2013

(30) Foreign Application Priority Data

Jun. 30, 2011 (JP) ..... 2011-145215

(51) Int. Cl.
*B41J 11/70* (2006.01)
*B41J 3/407* (2006.01)

(52) U.S. Cl.
CPC ..... *B41J 3/4075* (2013.01); *B41J 11/703* (2013.01)
USPC ..... 400/621

(58) Field of Classification Search
CPC ..... B41J 11/66; B41J 11/70
USPC ..... 400/621
See application file for complete search history.

(56) References Cited

U.S. PATENT DOCUMENTS 4,967,285 A * 10/1990 Tabuchi ..... 358/304
5,222,818 A * 6/1993 Akiyama et al. ..... 400/61
5,308,176 A * 5/1994 Yamaguchi ..... 400/618
6,270,270 B2 * 8/2001 Koshi et al. ..... 400/621
7,182,427 B2 * 2/2007 Tsuji et al. ..... 347/32
8,202,013 B2 * 6/2012 Kubota ..... 400/76
2013/0233913 A1 * 9/2013 Inoue et al. ..... 235/3

FOREIGN PATENT DOCUMENTS

JP 02152851 A * 6/1990 ..... B65H 19/20
JP 07052478 A * 2/1995 ..... B41J 11/70
JP 7-266622 A 10/1995
JP 3433354 B 8/2003
JP 2003231313 A * 8/2003 ..... B41J 11/70
JP 2008155417 A * 7/2008 ..... B41J 11/70
JP 2010-149416 A 7/2010

* cited by examiner

*Primary Examiner* — Nguyen Ha
(74) *Attorney, Agent, or Firm* — ALG Intellectual Property, LLC

(57) ABSTRACT

A tape printer control method including: (a) performing printing operation by driving a printing head while feeding a printing tape using a feed roller to which normal rotation power of a motor is transmitted via a gear train; (b) suspending the printing operation; (c) driving the motor slightly in the reverse rotation direction after the suspension of the printing operation to eliminate play in the reverse rotation direction produced by the backlash of the gear train without rotating the feed roller; (d) performing cutting operation for the printing tape using a tape cutter on the downstream side of the printing head in the tape feed direction; (e) driving the motor slightly in the normal rotation direction before restart of the printing operation to eliminate play in the normal rotation direction produced by the backlash of the gear train without rotating the feed roller; and (f) restarting the printing operation.

11 Claims, 8 Drawing Sheets

TAPE PRINTER CONTROL METHOD AND TAPE PRINTER

CROSS-REFERENCE

The entire disclosure of Japanese Patent Application No. 2011-145215 filed on Jun. 30, 2011, which is hereby incorporated by reference in its entirety.

BACKGROUND

A tape printer known in the art includes a printing head which performs printing on a long printing tape (label tape) line by line, a tape feed unit (including a motor and a feed roller) which forwards the label tape for the subsequent line printing, and a tape cutter which cuts the printing tape conveyed thereto (see Japanese Patent No. 3,433,354).

According to this type of tape printer, a cutting resistance produced when the label tape is cut by the tape cutter under suspension of printing draws the printing tape toward the tape cutter (toward the downstream side). In this case, the printing head faces to a portion of the printing tape shifted toward the upstream side from the portion thereof corresponding to the suspension. When printing is restarted for the next line printing in this condition, a linear missing part where no printing (no dots) is formed is produced between the next line and the line printed immediately before the suspension.

For avoiding this problem, a tape printer control method in the related art creates a line based on the printing data associated with the line before the suspension and prints the created line in such a manner as to overlap this line on the line printed before the suspension at the time of restart of printing, so as not to produce a missing line having no printing.

According to this related-art printer control method, however, the missing part only becomes inconspicuous by the overlap between the missing part and the part created based on the printing data immediately before the suspension. In this case, elimination of the missing part is achieved only by unnatural and wasteful printing, which may lead to deterioration of the printing quality.

Basically, the motor does not rotate along with the shift of the printing tape toward the downstream side caused by the cutting resistance, because the tape drawing direction is equivalent to the direction of speed increase of the gear train. However, the feed roller slightly rotates in the normal rotation direction in accordance with the shift of the printing tape by the amount corresponding to play in the reverse rotation direction produced by the backlash of the gear train. When printing is restarted in this condition, the gear train idles by the amount corresponding to play in the normal rotation direction. In this case, an error is produced in the number of revolutions of the feed roller.

SUMMARY

Various embodiments may provide a tape printer control method and a tape printer, capable of effectively preventing deviation between relative positions of a printing tape and a printing head resulting from a cutting resistance produced by a tape cutter.

According to at least one embodiment of the disclosure, there is provided a tape printer control method including: (a) performing printing operation by driving a printing head while feeding a printing tape using a feed roller to which normal rotation power of a motor is transmitted via a gear train; (b) suspending the printing operation; (c) driving the motor slightly in the reverse rotation direction after the suspension of the printing operation so as to eliminate play in the reverse rotation direction produced by the backlash of the gear train without rotating the feed roller; (d) performing cutting operation for the printing tape using a tape cutter on the downstream side of the printing head in the tape feed direction; (e) driving the motor slightly in the normal rotation direction before restart of the printing operation so as to eliminate play in the normal rotation direction produced by the backlash of the gear train without rotating the feed roller; and (f) restart of the printing operation.

According to this method, the motor is slightly driven in the reverse rotation direction immediately after the start of suspension of the printing operation so as to eliminate the play in the reverse rotation direction produced by the backlash of the gear train. In this case, an arbitrary pair of gears constituting the gear train have no play in the reverse rotation direction produced by the backlash, but have play in the normal rotation direction. This condition prevents slight rotation of the feed roller within the range of the play in the reverse rotation direction caused by the subsequent cutting operation executed for the printing tape using the tape cutter.

Moreover, the motor is slightly driven in the normal rotation direction immediately before the restart of the printing operation so as to eliminate the play in the normal rotation direction produced by the backlash of the gear train. In this case, an arbitrary pair of gears constituting the gear train have no play in the normal rotation direction produced by the backlash, but have play in the reverse rotation direction. This condition prevents idling of the motor and the gear train, thereby accurately rotating the feed roller.

In this case, it is preferable that the play in the reverse rotation direction is eliminated by plugging which applies driving voltage to the motor in the reverse rotation direction.

According to this configuration, driving voltage is applied to the motor in the reverse rotation direction so as to apply braking to the normal rotation of the feed roller (feed of ink ribbon) along with the suspension of the printing. This method can decrease the rotation speeds of the feed roller and the gear train within a short period, and eliminate the play in the reverse rotation direction produced by the backlash.

In this case, it is preferable that the play in the normal rotation direction is eliminated by both of slight rotation of the motor in the normal rotation direction caused by applying a driving voltage sufficient for rotating the feed roller to the motor, and of inertial rotation of the motor.

According to this configuration, the respective gears constituting the gear train rotate in such a direction as to eliminate the play in the normal rotation direction in accordance with the slight rotation of the motor. Then, the tooth surfaces of the respective gears come into contact with each other in accordance with the inertial rotation of the motor. Accordingly, this method can eliminate the play produced by the backlash of the gear train without operating the operation target.

In this case, it is preferable that the play in the normal rotation direction is eliminated by slight rotation of the motor in the normal rotation direction caused by applying a low driving voltage insufficient for rotating the feed roller to the motor.

According to this configuration, the low voltage insufficient for driving the feed roller is applied to the motor so as to rotate the motor in such a direction as to eliminate the play in the normal rotation direction. Therefore, even when the driving of the motor continues after the contact between the tooth surfaces of the respective gears, the feed roller does not rotate. Accordingly, the printing operation restarts from the accurate position.

According to at least one embodiment of the disclosure, there is provided a tape printer including: a motor for functioning as a power source; a feed roller which rotates by the power of the motor to feed a printing tape; a gear train which transmits the power of the motor to the feed roller; a printing head for performing printing on the printing tape being fed; a tape cutter disposed on the downstream side of the printing head in the tape feed direction to cut the printing tape; and a controller for controlling the motor, the printing head, and the tape cutter. During suspension of the printing operation for allowing execution of the cutting operation for the printing tape, which cutting operation is followed by restart of the printing operation, the controller slightly drives the motor in the reverse rotation direction after the suspension of the printing operation so as to eliminate play in the reverse rotation direction produced by the backlash of the gear train without rotating the feed roller, and slightly drives the motor in the normal rotation direction before the restart of the printing operation so as to eliminate play in the normal rotation direction produced by the backlash of the gear train without rotating the feed roller.

According to this configuration, the motor is slightly rotated in the reverse rotation direction immediately after the start of suspension of the printing operation to eliminate the play in the reverse rotation direction produced by the backlash of the gear train. On the other hand, the motor is slightly rotated in the normal rotation direction immediately before the restart of the printing operation to eliminate the play in the normal rotation direction. This structure prevents slight rotation of the feed roller within the range corresponding to the play in the reverse rotation direction caused by the cutting operation executed for the printing tape using the tape cutter between the step for eliminating the play in the reverse rotation direction and the step for eliminating the play in the normal rotation direction. Moreover, this structure prevents idling of the motor and the gear train, thereby accurately rotating the feed roller. Accordingly, the printing quality can be maintained in a preferable condition.

BRIEF DESCRIPTION OF THE DRAWINGS

The invention will be described with reference to the accompanying drawings, wherein like reference numbers reference like elements.

DESCRIPTION OF EXEMPLARY EMBODIMENT

A tape printer according to an embodiment of the invention is hereinafter described with reference to the accompanying drawings. The tape printer in this embodiment performs printing while drawing a printing tape from a tape cartridge attached to the tape printer as a unit accommodating the printing tape wound in a roll shape, and an ink ribbon from a ribbon cartridge attached to the tape printer as a unit accommodating the ink ribbon, with the printing tape and the ink ribbon traveling side by side. After printing, the tape printer cuts the printed portion of the printing tape to produce a label.

Figure 1:
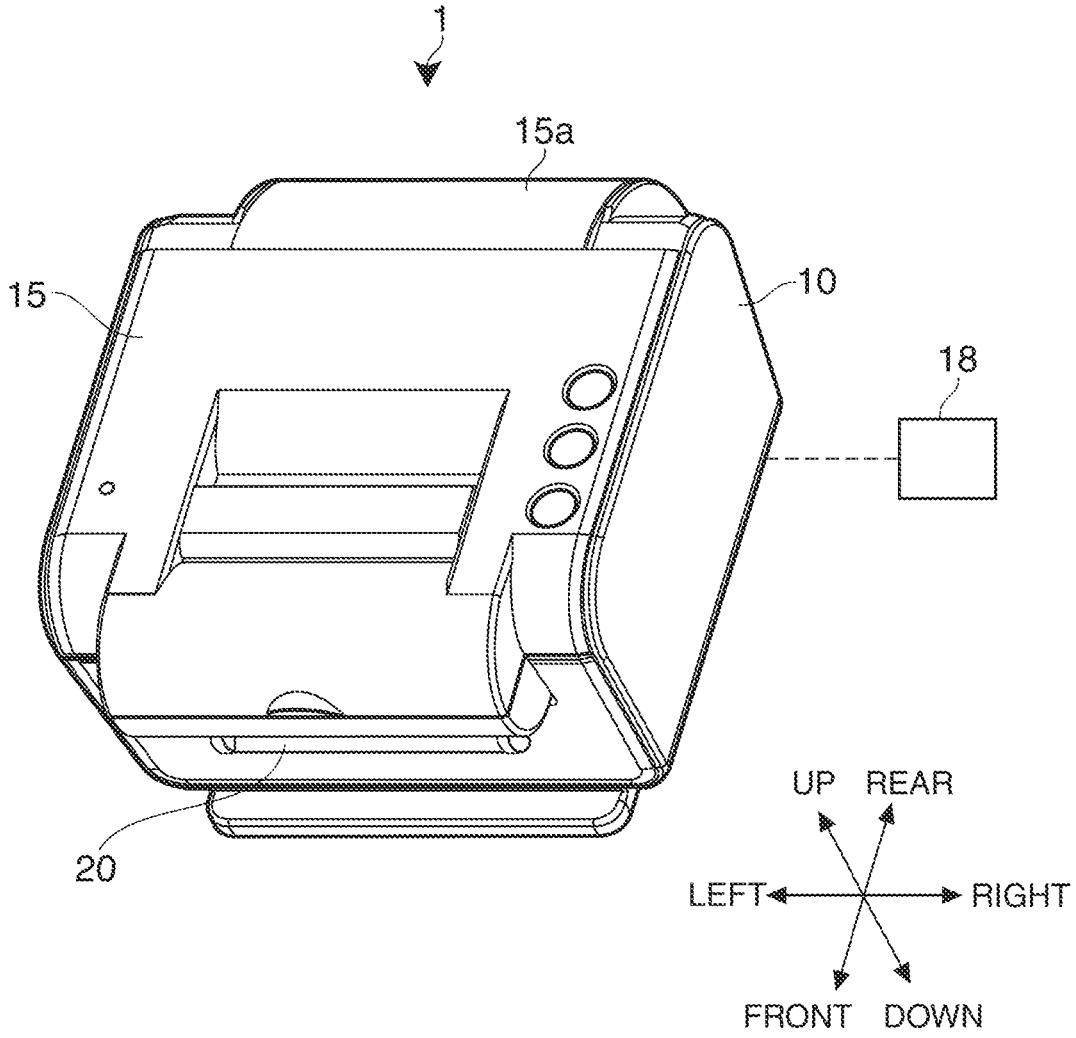
FIG. 1 is a perspective view illustrating the external appearance of a tape printer according to an embodiment.
Figure 2:
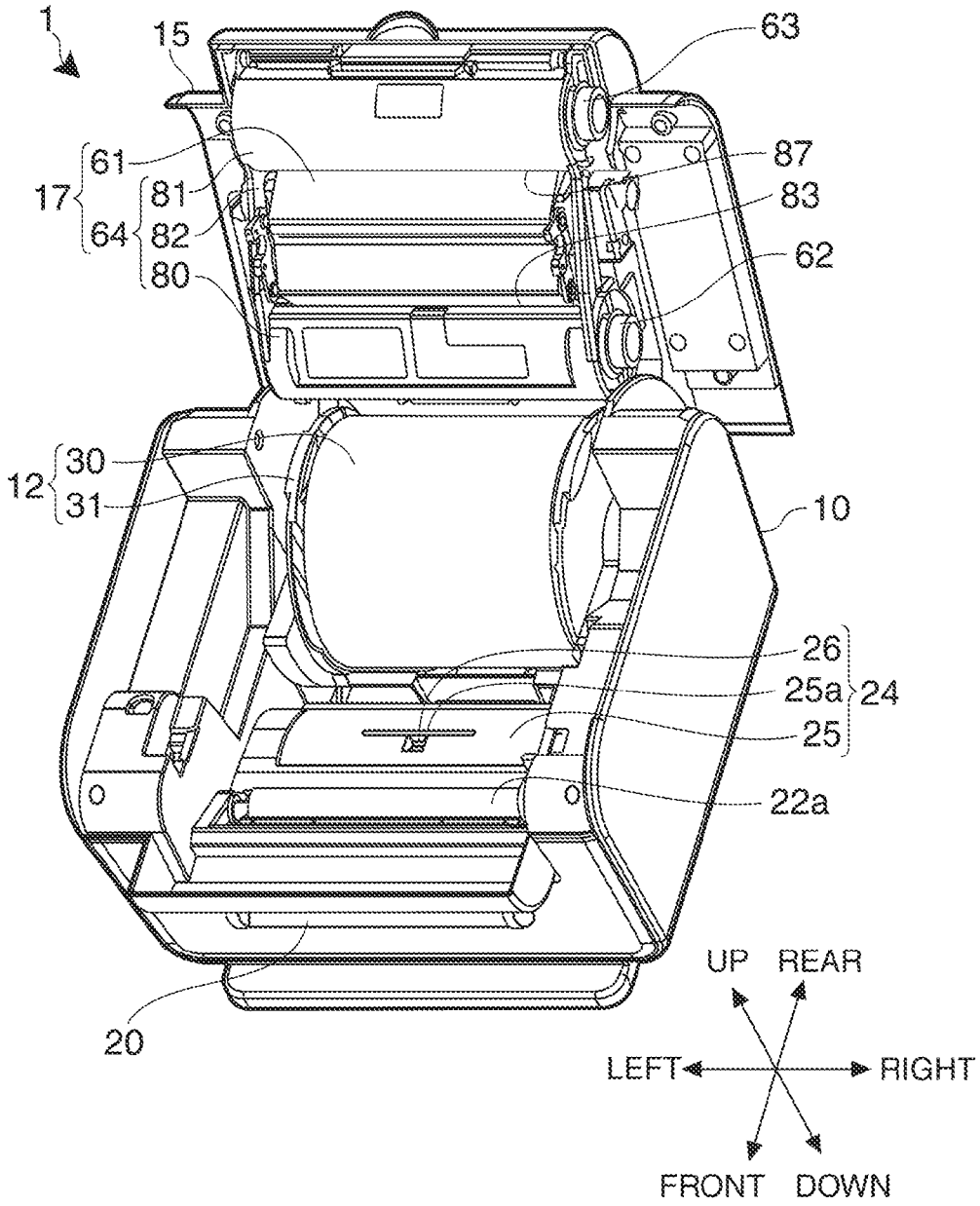
FIG. 2 is a perspective view of the external appearance of the tape printer to which a tape cartridge and a ribbon cartridge are attached with a cover case opened.
Figure 3:
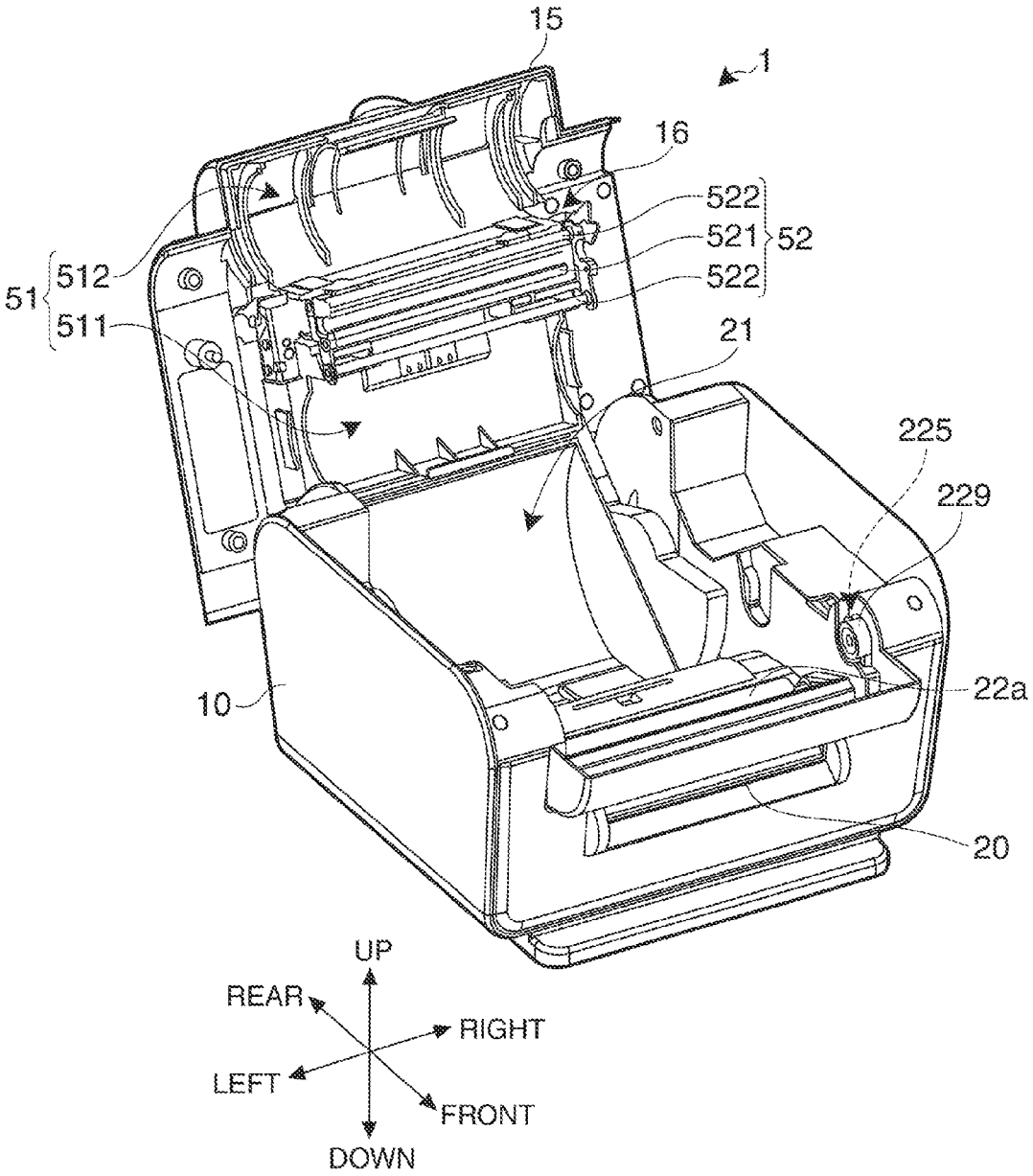
FIG. 3 is a perspective view of the external appearance of the tape printer from which the tape cartridge and the ribbon cartridge are removed with the cover case opened.
Figure 4:
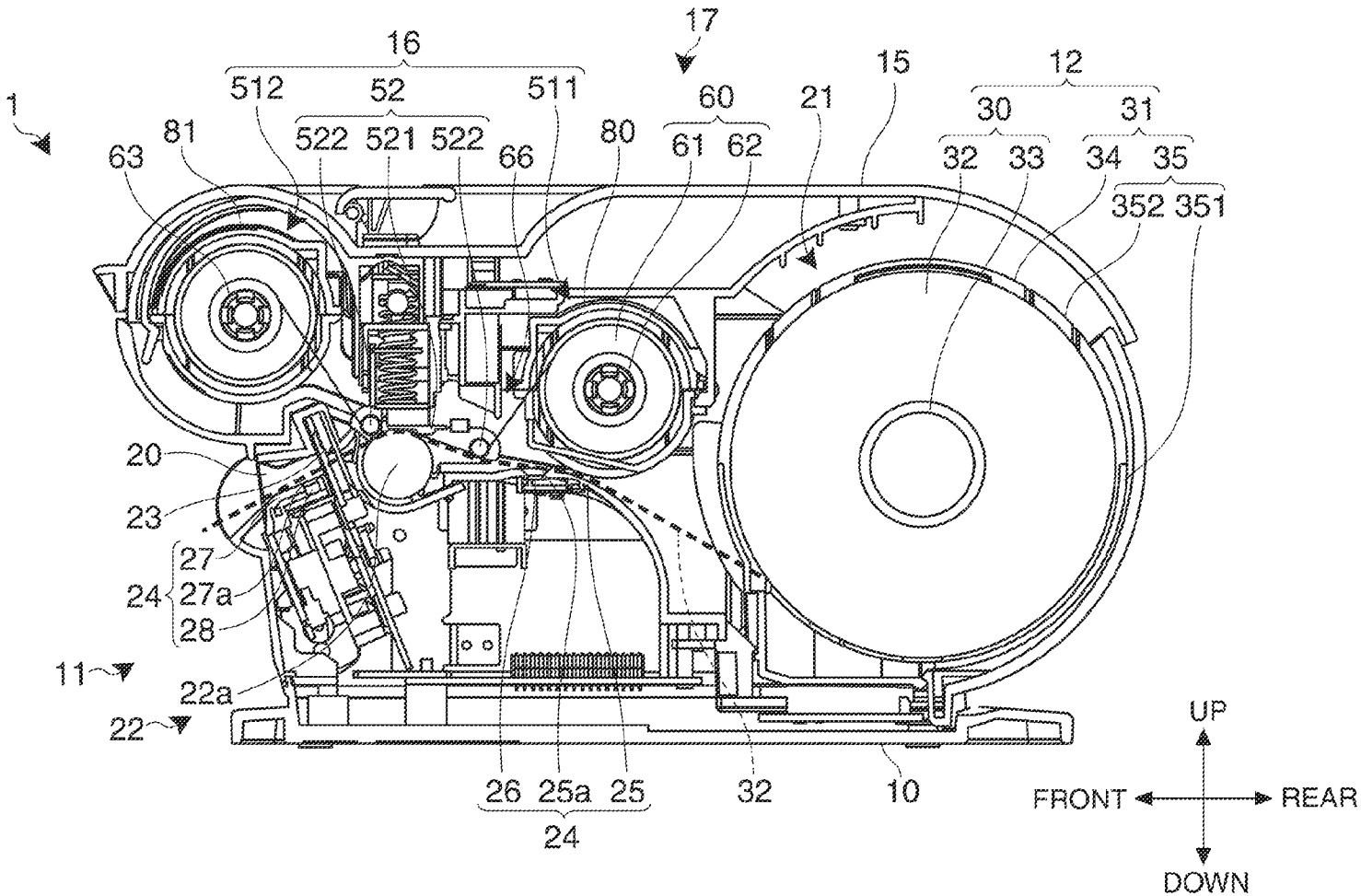
FIG. 4 is a side cross-sectional view of the tape printer according to the embodiment.
Figure 5:
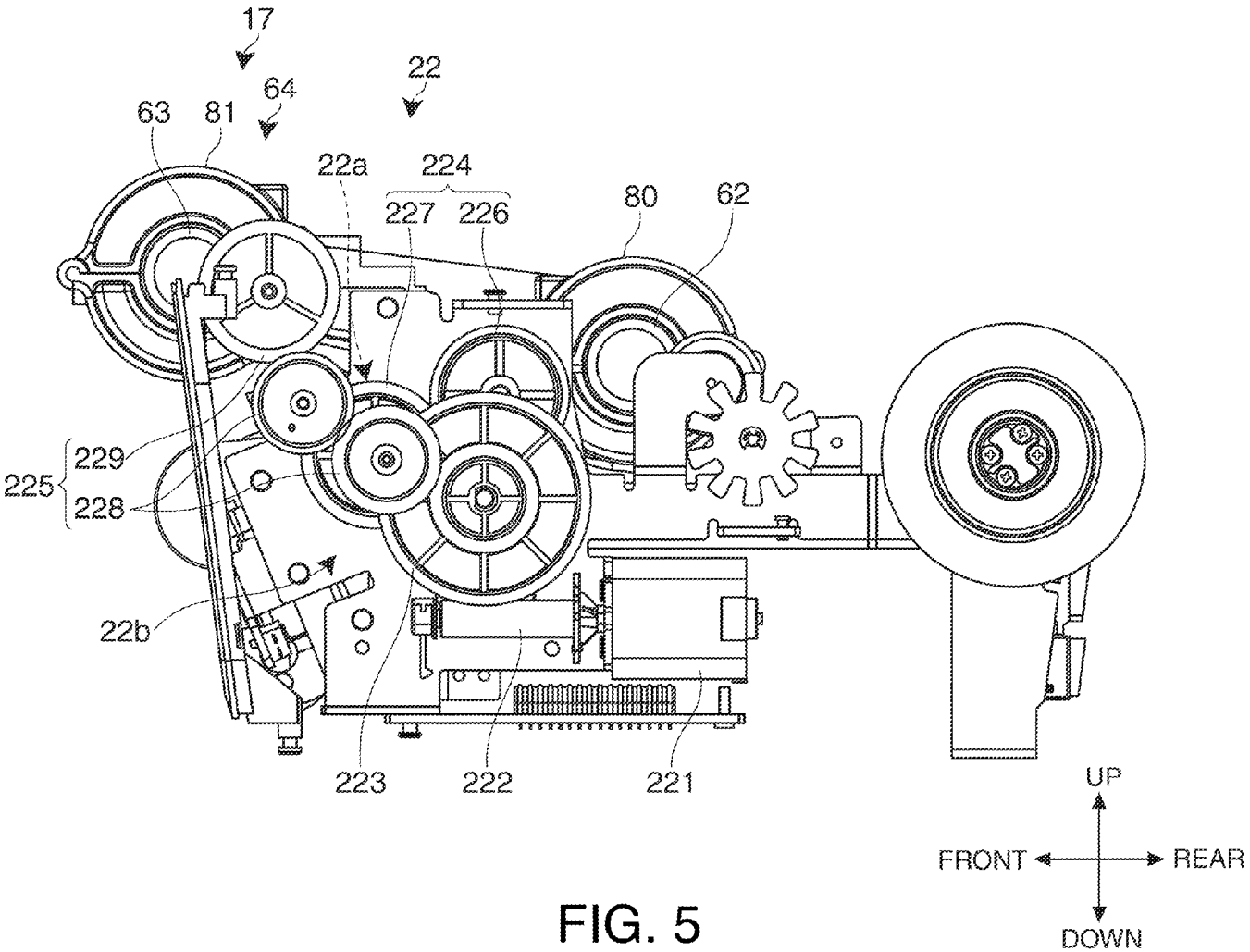
FIG. 5 is a side view of a feed driver included in a tape feed mechanism.

A tape printer 1 is now explained with reference to FIGS. 1 through 5. FIG. 1 is a perspective view illustrating the external appearance of the tape printer 1. FIG. 2 is a perspective view illustrating the external appearance of the tape printer 1 to which a tape cartridge 12 and a ribbon cartridge 17 are attached with a cover case 15 opened. FIG. 3 is a perspective view illustrating the external appearance of the tape printer 1 from which the tape cartridge 12 and the ribbon cartridge 17 are removed with the cover case 15 opened. FIG. 4 is a side cross-sectional view of the tape printer 1. FIG. 5 is a side view of a feed driver 22*b* of a tape feed mechanism 22. In the following description, the up-down direction, the front-rear direction, and the left-right direction are specified in conformity with the corresponding directions of arrows indicated in the respective figures.

As illustrated in FIGS. 1 through 4, the tape printer 1 includes a main body case 10 constituting the main external case of the tape printer 1, a feed assembly 11 incorporated into the main body case 10, the tape cartridge 12 detachably attached to the interior of the feed assembly 11, the cover case 15 as an openable and closable cover provided to cover the upper part of the main body case 10, a printing assembly 16 incorporated into the cover case 15, and the ribbon cartridge 17 detachably attached to the interior of the printing assembly 16.

The tape printer 1 further contains a controller (not shown) which controls the operations of the respective components constituting the tape printer 1. Moreover, a control terminal 18 (such as a personal computer) is connected to the tape printer 1 via a connection port, through which terminal 18 a user of the tape printer 1 allows the tape printer 1 to perform printing. The main body case 10 and the cover case 15 constitute a device case which forms the entire external appearance of the tape printer 1.

A sheet outlet 20 is provided at the front center of the main body case 10 as a port through which a printing tape 32 after printing is discharged to the outside. The printing tape 32 is drawn from the tape cartridge 12 disposed at the rear part, and subjected to printing while traveling toward the sheet outlet 20.

Feed Assembly

The feed assembly 11 includes a tape attachment portion 21 to which the tape cartridge 12 is attached, the tape feed mechanism 22 (see FIGS. 4 and 5) which forwards the printing tape 32 while drawing the printing tape 32 from the tape cartridge 12, a cutter mechanism 23 which cuts the printing tape 32 after printing, and a tape detection mechanism 24 which detects the presence or absence of the printing tape 32 drawn onto the feed route.

The tape attachment portion 21 provided inside the rear part of the main body case 10 is concaved such that the tape cartridge 12 housed in the tape attachment portion 21 can be located at the center of the main body case 10 (in the left-right direction).

As illustrated in FIGS. 3 through 5, the tape feed mechanism 22 disposed before the tape attachment portion 21 includes a so-called platen roller 22*a*, and the feed driver 22*b* which rotates the platen roller 22*a*. The platen roller 22*a* contacts the lower surface of the printing tape 32 drawn from the tape cartridge 12 to forward the printing tape 32 in cooperation with a thermal head 521 (described later) toward the sheet outlet 20 provided before the platen roller 22*a* as a port communicating with the platen roller 22*a* (see a broken line in FIG. 4).

As illustrated in FIG. 5, the feed driver 22*b* includes a DC motor 221 functioning as a power source, a worm gear 222 connected with the output shaft of the DC motor 221, a worm wheel gear 223 engaging with the worm gear 222, a platen side gear train 224 for transmitting the rotation force to the platen roller 22*a*, and a winding side gear train 225 for transmitting the rotation force to a winding core 63 (described later) of the ribbon cartridge 17. The feed driver 22*b* rotates the platen roller 22*a* and the winding core 63 in synchronization with each other.

The platen side gear train 224 has a platen input gear 226 engaging with the worm wheel gear 223, and a platen output gear 227 engaging with the platen input gear 226 and attached (rotatably attached) to one end of the platen roller 22*a*.

The winding side gear train 225 has a winding input gear train 228 engaging with the worm wheel gear 223, and a winding output gear 229 engaging with the output side gear of the winding input gear train 228 and engaging a winding side gear (not shown) attached to the winding core 63.

It is obvious and needs scarcely be explained that the respective gears have backlash between each other. This backlash produces play which causes slight looseness of the platen roller 22*a* in its rotation direction. According to this embodiment, the tape printer 1 (controller) controls the driving of the DC motor 221 in such a manner as to eliminate the play produced by the backlash prior to start of the printing operation and before and after the tape cutting operation by the cutter mechanism 23, the details of which control will be described later. It should be noted that the backlash between the worm gear 222 as a screw gear and the worm wheel gear 223 need not be considered. In addition, the worm gear 222 does not rotate with the platen roller 22*a* when a rotational force is given to the platen roller 22*a*.

As illustrated in FIG. 4, the cutter mechanism 23 is a so-called scissors-type unit whose fixed cutter and movable cutter face to each other in the up-down direction with the printing tape 32 interposed between the cutters. The cutter mechanism 23 is disposed before the platen roller 22*a*. The printing tape 32 after printing is cut by the cutter mechanism 23, and discharged through the sheet outlet 20 to the outside.

As illustrated in FIGS. 2 and 4, the tape detection mechanism 24 is a so-called reflection type photo-sensor, and includes a first photoelectric element 26 incorporated into a first slidingly contact member 25 disposed between the tape cartridge 12 and the tape feed mechanism 22, and a second photoelectric element 28 incorporated into a second slidingly contact member 27 provided on the sheet outlet 20 before the cutter mechanism 23. The first photoelectric member 26 and the second photoelectric member 28 are disposed in such positions as to face to the lower surface of the printing tape 32.

Each of the first photoelectric element 26 and the second photoelectric element 28 has a light emitting element and a light receiving element (not shown) so as to detect the presence or absence of the printing tape 32 based on determination whether the light emitted from the light emitting element is received by the light receiving element. According to this embodiment, the tape printer 1 (controller) stops the tape feed mechanism 22 and a printing mechanism 52 when the first photoelectric element 26 does not receive the reflection light due to the absence of the printing tape 32. In other words, the tape end can be detected based on determination whether the printing tape 32 is present or absent using the first photoelectric element 26. By detection of the tape end, so-called no-tape printing (printing without supply of tape) can be avoided, whereby deterioration of the platen roller 22*a* and the thermal head 521 and damage thereto caused by no-tape printing can be effectively prevented. On the other hand, the second photoelectric element 28 detects discharge of the printing tape 32.

The first slidingly contact member 25 and the second slidingly contact member 27 define a route (feed route) through which the drawn printing tape 32 is transferred while slidingly contacting the first slidingly contact member 25 and the second slidingly contact member 27. Each of the first and second slidingly contact members 25 and 27 has substantially the same width as the maximum width of the printing tape 32, and has a table shape. A first opening 25*a* is provided substantially at the center of the first slidingly contact member 25 in the left-right direction to form an optical path for the first photoelectric element 26, while a second opening 27*a* is formed in a similar manner in the second slidingly contact member 27 to form an optical for the second photoelectric element 28. The light emitting element and the light receiving element (not shown) of the first photoelectric element 26 are provided within the first opening 25*a* in such positions as not to project from the upper end surface of the first slidingly contact member 25. Similarly, the light emitting element and the light receiving element (not shown) of the second photoelectric element 28 are provided within the second opening 27*a* in such positions as not to project from the upper end surface of the second slidingly contact member 27.

According to this structure, the tape detection mechanism 24 is so designed as to detect the printing tape 32 on each of the slidingly contact members 25 and 27, and to maintain constant distances between the printing tape 32 and the photoelectric element 26 and between the printing tape 32 and the photoelectric element 28. In this case, the respective distances between the printing tape 32 and the photoelectric element 26 and between the printing tape 32 and the photoelectric element 28 can be kept constant even when the printing tape 32 slightly shifts on the feed route during transfer. Accordingly, detection of the printing tape 32 can be achieved in a secure and stable condition. The first slidingly contact member 25 and the second slidingly contact member 27 may be eliminated when diffusion or reflection of light is desired to be reduced to the minimum.

Tape Cartridge

Figure 6A:
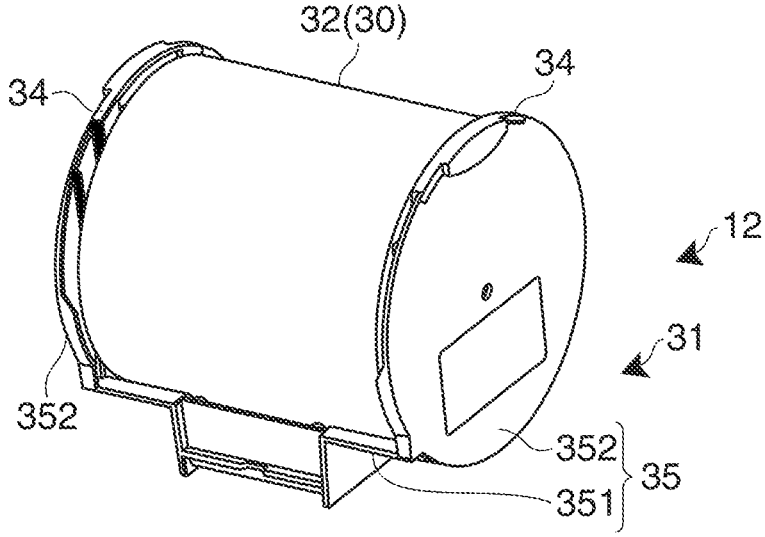
FIG. 6A is a perspective view of the tape cartridge.

The details of the tape cartridge 12 are now discussed with reference to FIGS. 2, 4, 6A and 6B. FIG. 6A is a perspective view of the tape cartridge 12, and FIG. 6B is a perspective view of a tape body 30 and shaft holders 34.

The tape cartridge 12 has the tape body 30 which contains the printing tape 32 wound around a tape core 33, and a cartridge case 31 which supports the tape core 33 such that the tape core 33 can freely rotate. The tape cartridge 12 is detachably attached to the tape attachment portion 21. The tape cartridge 12 contains the printing tape 32 of various types which are different in width, color and the like, and of the type called rolled paper or a die-cut tape prepared as a user friendly tape.

The printing tape 32 is constituted by a so-called die-cut tape (not shown in detail in the figure) which has a plurality of labels affixed to long released paper at equal intervals. The released paper is made of thin material having lower strength than that of the labels.

Figure 6B:
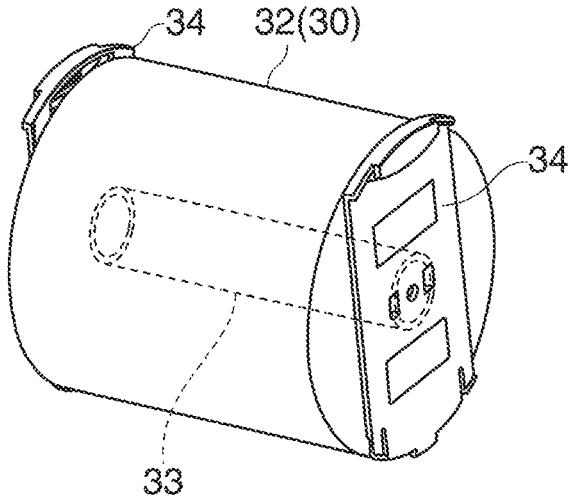
FIG. 6B is a perspective view of a tape body and shaft holders.

As illustrated in FIG. 6B, the tape body 30 has the tape core 33 made of paper and having a hollow cylindrical shape, and the printing tape 32 wound around the outer circumference of the tape core 33. The tape body 30 is rotatably supported by the shaft holders 34 disposed at both ends of the tape core 33 in the axial direction. Adhesive sheets (not shown) are affixed to both end surfaces of the tape body 30 so as to prevent separation of the wound printing tape 32.

As illustrated in FIG. 6A, the cartridge case 31 has a pair of the shaft holders 34 supporting both ends of the tape body 30 (tape core 33), and a main body case 35. The tape body 30 is housed in the main body case 35 and the shaft holders 34.

The main body case 35 has a tape cover portion 351 covering the lower circumferential surface of the tape body 30, and a pair of side walls 352 standing at both ends of the tape cover portion 351 in the left-right direction. The rear part of the tape cover portion 351 is curved along the circumferential surface of the tape body 30. Each of the side walls 352 has a disk shape whose diameter is larger than that of the tape body 30. A plurality of projections (not shown) are provided on the lower surface of the tape cover portion 351 to be detected when determining the type of the printing tape 32.

A position regulating groove (not shown) is formed in each of the inner surfaces of the side walls 352 substantially at the center thereof in the front-rear direction as a slightly concaved portion extending in the up-down direction in a shape substantially complementary to the shape of the shaft holder 34. Under engagement between the pair of the shaft holders 34 supporting the tape body 30 and the position regulating grooves of the respective side walls 352, the tape body 30 and the respective side walls 352 are located substantially coaxial.

Cover Case

As illustrated in FIGS. 1 through 4, the cover case 15 rotates around a hinge 15*a* provided at the rear end of the cover case 15 with the front part of the cover case 15 jumping upward, so as to function as an openable and closable cover capable of opening the feed assembly 11 (tape attachment portion 21). While the cover case 15 is open, the printing assembly 16 (ribbon attachment portion 51) also opens. Thus, for replacement of the tape cartridge 12 and the ribbon cartridge 17, and maintenance of the respective mechanisms, the cover case 15 is opened so as to open the feed assembly 11 and the printing assembly 16.

Printing Assembly

As illustrated in FIGS. 2 through 4, the printing assembly 16 includes the ribbon attachment portion 51 to which the ribbon cartridge 17 is attached, and the printing mechanism 52 which performs printing on the printing tape 32.

The ribbon attachment portion 51 has a draw out attachment portion 511 concaved in the inner surface of the cover case 15 behind the printing mechanism 52, and a winding attachment portion 512 concaved before the printing mechanism 52. In this structure, the ribbon cartridge 17 is attached to the ribbon attachment portion 51 while crossing over the printing mechanism 52. As illustrated in FIGS. 2 and 3, the draw out attachment portion 511 is located on the front side with respect to the winding attachment portion 512 (on the lower side with respect to the winding attachment portion 512 in the closed condition of the cover case 15).

The printing mechanism 52 includes the so-called thermal head 521, a head driver (not shown) for controlling the drive of the thermal head 521, and a pair of ribbon route change shafts 522 disposed before and behind the thermal head 521 to change a traveling path 66 of an ink ribbon 61 to such positions that the ink ribbon 61 can face to the heat generating portion of the thermal head 521. The thermal head 521 is disposed close to the platen roller 22*a* in such a position as to slidingly contact the upper surface of the printing tape 32 with the ink ribbon 61 interposed between the thermal head 521 and the printing tape 32 (see FIG. 4).

Ribbon Cartridge

The details of the ribbon cartridge 17 are now explained with reference to FIGS. 2, 4, and 5. As illustrated in FIGS. 2, 4, and 5, the ribbon cartridge 17 has a ribbon body 60 which contains the ink ribbon 61 and a draw out core 62 around which the ink ribbon 61 is wound, a winding core 63 around which the used ink ribbon 61 is wound, and a ribbon case 64 which supports the draw out core 62 and the winding core 63 such that both the cores 62 and 63 can freely rotate.

The ribbon case 64 has a draw out case 80 which houses the draw out core 62 such that the draw out core 62 can freely rotate, a winding case 81 which houses the winding core 63 such that the winding case 63 can freely rotate, and a pair of connecting portions 82 as junctions extending in the front-rear direction between the left ends of the draw out case 80 and the winding case 81 and between the right ends of the draw out case 80 and the winding case 81 with the traveling path 66 of the ink ribbon 61 positioned between the draw out case 80 and the winding case 81. The ink ribbon 61 drawn from the ribbon body 60 through a ribbon outlet 83 formed in the draw out case 80 passes along the traveling path 66 while exposed to the outside, and enters a ribbon inlet port 87 formed in the winding case 81 to be wound around the winding core 63.

Attachment of Ribbon Cartridge

For attachment of the ribbon cartridge 17 to the ribbon attachment portion 51 as illustrated in FIG. 2, the draw out case 80 is initially attached to the draw out attachment portion 511. Then, the winding case 81 is attached to the winding attachment portion 512 by rotating the winding case 81 around the draw out case 80 as the rotation axis. After completion of this attachment, the ink ribbon 61 drawn onto the traveling path 66 is brought into contact with the thermal head 521 and the pair of the ribbon route change shafts 522.

During this attachment, there is a possibility of contact between the winding case 81 rotated for attachment to the winding attachment portion 512 and the thermal head 521 and the ribbon route change shaft 522 on the downstream side. This contact can be avoided when the clearance between the draw out case 80 and the winding case 81 (traveling path 66) is long. When the traveling path 66 is long, however, problems such as size increase in the ribbon cartridge 17 (tape printer 1) and easy looseness of the ink ribbon 61 may arise.

According to the ribbon attachment portion 51 in this embodiment, attachment of the draw out case 80 is facilitated by the arrangement of the draw out attachment portion 511 on the front side with respect to the winding attachment portion 512 as illustrated in FIGS. 2 and 3. In this case, the draw out attachment portion 511 is located on the lower side with respect to the winding attachment portion 512 in the state that the ribbon cartridge 17 is attached to the ribbon attachment portion 51 and the cover case 15 is closed (see FIG. 4). This structure can prevent contact between the rotated winding case 81 and the thermal head 521 and the ribbon route change shaft 522 on the downstream side without elongating the traveling path 66.

Feed Route of Printing Tape

As illustrated in FIG. 4, the printing tape 32 is sandwiched between the thermal head 521 and the platen roller 22*a* with the ink ribbon 61 interposed between the thermal head 521 and the printing tape 32, and subjected to printing by the thermal head 521 while drawn out of the tape body 30 in accordance with the rotation of the platen roller 22*a*. Printing is performed along with synchronous rotations of the winding core 63 and the platen roller 22*a* by the drive of the DC motor 221. The printing tape 32 after printing is conveyed toward the sheet outlet 20, whereas the ink ribbon 61 is wound around the winding core 63. Each of the thermal head 521 and the platen roller 22*a* has substantially the same width as the maximum width of the printing tape 32.

Play Eliminating Method Before Printing Start

During printing by the tape printer 1 thus constructed, the thermal head 521 is pressed toward the platen roller 22*a* at a predetermined pressure with the printing tape 32 and the ink ribbon 61 interposed between the thermal head 521 and the platen roller 22*a*. In this condition, the platen roller 22*a* (and the winding core 63) can rotate without slipping. It is further appreciated that printing is an operation performed in synchronization with the drive of the DC motor 221. However, the platen roller 22*a* slightly loosens in the feed direction when play is produced due to backlash of the gear train as the transmitter of the driving force to the platen roller 22*a*, which backlash is caused by vibration given as a result of the opening action of the cover case 15 for replacement of the tape cartridge 12 and the ribbon cartridge 17, or shift of the tape printer 1 to another place, for example.

When the tooth surfaces of the respective gears contact each other in the direction for rotating the platen roller 22*a* in the normal rotation direction, the driving force (rotational force) from the DC motor 221 can be transmitted without delay, allowing the printing process to be carried out in the normal condition. However, when play (clearance) produced by backlash lies in the normal rotation direction of the platen roller 22*a*, the platen roller 22*a* does not rotate during its shift in the range of this play (clearance) even in the condition of rotations of the DC motor 221, the platen side gear train 224, and others. In other words, the DC motor 221, the platen side gear train 224, and others are idling during this period. The "idling" in this context means the rotation condition of the DC motor 221, the platen side gear train 224, and others in which the platen roller 22*a* does not rotate even while the DC motor 221, the platen side gear train 224, and others are rotating.

When printing is started under this condition in synchronization with the drive of the DC motor 221, printing proceeds without supply of the printing tape 32 by the platen roller 22*a*. In this case, abnormalities occur in the printing condition. Moreover, whether the contact between the tooth surfaces of an arbitrary pair of the gears lies in the normal rotation direction or the reverse rotation direction is difficult to be recognized.

For solving this problem, the tape printer 1 in this embodiment controls the operation of the feed driver 22*b* which eliminates play produced by the backlash of the platen side gear train 224 prior to the start of printing.

Figure 7A:
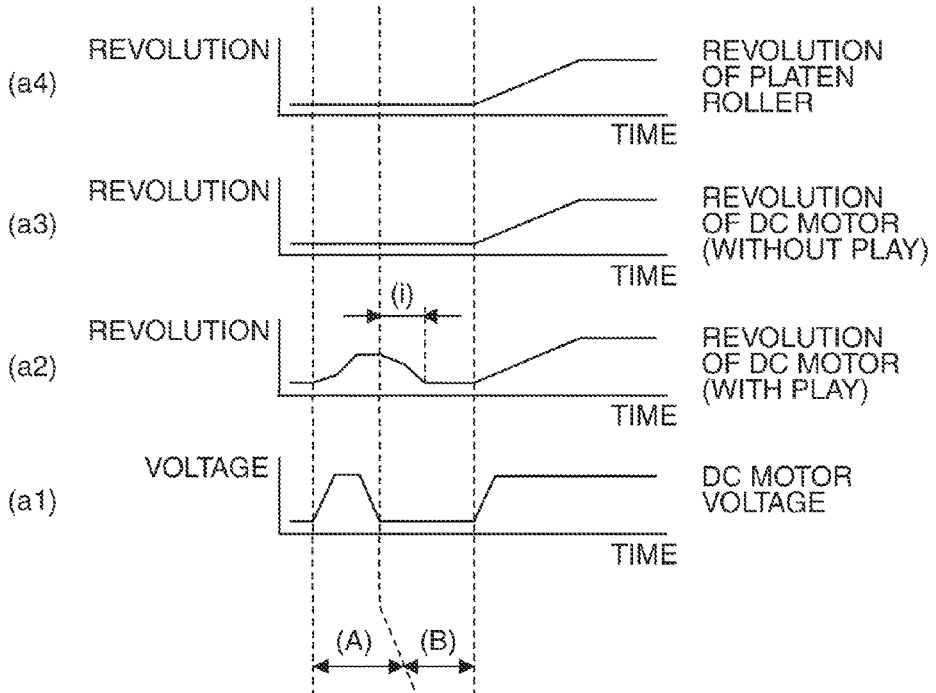
FIG. 7A is a graph representing the change of voltage applied to a DC motor with time, and the changes of the numbers of revolutions of the DC motor and a platen roller with time.
Figure 7B:
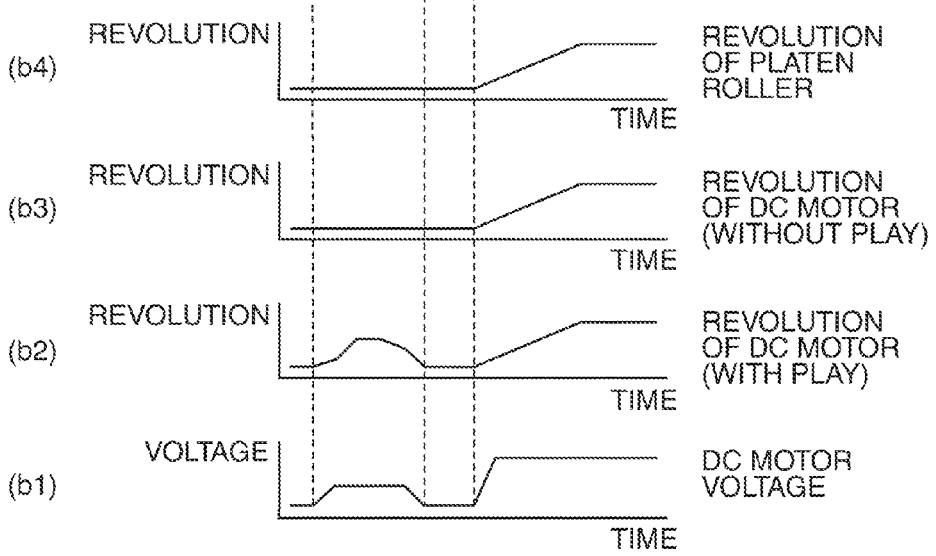
FIG. 7B is a graph representing the respective changes with time according to a modified example shown in association with the corresponding changes in FIG. 7A.

The method for controlling the feed driver 22*b* of the tape printer 1 according to this embodiment is now explained with reference to FIGS. 7A and 7B. FIG. 7A is a graph representing the change of the voltage applied to the DC motor 221 with time, and the changes of the numbers of revolutions of the DC motor 221 and the platen roller 22*a* with time. FIG. 7B is a graph representing the respective changes with time according to a modified example shown in association with the corresponding changes in FIG. 7A.

The method for controlling the feed driver 22*b* by the controller of the tape printer 1 includes a play eliminating step for eliminating play produced by the backlash of the platen side gear train 224 by slight driving of the DC motor 221 prior to the rotation of the platen roller 22*a*, i.e., prior to forwarding of the printing tape 32, without rotation of the platen roller 22*a*.

The play eliminating step removes the play through slight rotation of the DC motor 221 caused by applying a driving voltage (normal voltage) sufficient for rotating the platen roller 22*a* to the DC motor 221, and through inertial rotation of the platen roller 22*a*. More specifically, the normal voltage is applied to the DC motor 221 for a short period (period "A" in FIGS. 7A and 7B) during which the platen roller 22*a* does not rotate as illustrated in a graph a1 in FIG. 7A. The time for applying the normal voltage is set at 10 msec. in this embodiment.

When the play (clearance) produced by the backlash lies in the normal rotation direction under this condition, the driving force of the DC motor 221 slightly rotates the worm wheel gear 223, and the platen input gear 226 and the platen output gear 227 constituting and the platen side gear train 224 in the normal rotation direction as illustrated in a graph a2 in FIG. 7A. In this case, the respective gears 223, 226, and 227 rotate in the direction of eliminating the clearance by the slight rotation of the DC motor 221. After cutoff of the normal voltage to the DC motor 221, the respective gears 223, 226, and 227 inertially rotate in the normal rotation direction (see period "i" in FIG. 7A). Then, the tooth surfaces of the respective gears 223, 226, and 227 come into contact with each other, whereby the rotations of the gears 223, 226, and 227 come to a stop. By this method, the play produced by the backlash of the platen side gear train 224 can be eliminated without rotation of the platen roller 22*a*.

On the other hand, when the play (clearance) produced by the backlash lies in the reverse rotation direction, that is, when the tooth surfaces of the respective gears 223, 226, and 227 contact each other in the normal rotation direction, the respective gears 223, 226, and 227, and the platen roller 22*a* do not rotate even when the normal voltage is applied to the DC motor 221 for a short period as illustrated in a graph a3 in FIG. 7A. This is because the normal voltage is applied to the DC motor 221 for only an extremely short period and therefore does not produce power sufficient for rotating the respective gears 223, 226, and 227, and the platen roller 22*a*.

After completion of the play eliminating step (after the elapse of a period "B" in FIGS. 7A and 7B), the DC motor 221 is rotated so as to rotate the platen roller 22*a* in the normal rotation direction for the purpose of printing (see graph a4 in FIG. 7A).

According to this method, the play produced by the backlash can be easily eliminated by the same control regardless of the direction of the contact between the tooth surfaces of the respective gears 226 and 227 constituting the platen side gear train 224 (normal rotation direction or reverse rotation direction). Moreover, the DC motor 221 rotates the platen roller 22*a* without idling, whereby the normal feeding of the printing tape 32 and the driving of the printing head 32*a* can be synchronized with each other in the normal condition. Accordingly, printing can be accurately performed on the printing tape 32 without abnormalities in the printing condition.

According to the method for controlling the feed driver 22*b* in this embodiment (play eliminating step), control over the drive of the DC motor 221 is achieved by switchover between ON and OFF of the power (voltage application). However, the drive of the DC motor 221 may be controlled by using other known control methods such as PWM control. In this embodiment, the method for controlling the feed driver 22*b* is automatically performed prior to the printing operation under the control of the controller included in the tape printer 1.

However, the control method may be arbitrarily conducted by the user through the operation of the control terminal 18. When the DC motor 221 is rotated, this rotation is transmitted to the winding side gear train 225. However, since the winding side gear train 225 also has backlash, the winding core 63 does not rotate with this rotation similarly to the platen side gear train 224.

Play Eliminating Method Before Print Start

Modified Example

According to the method for controlling the feed driver 22*b* using the controller of the tape printer 1 (play eliminating step), play (clearance) produced by the backlash of the platen side gear train 224 and others is eliminated by controlling the time for applying the normal voltage to the DC motor 221. However, this play may be eliminated by changing (decreasing) the voltage applied to the DC motor 221. Explained hereinafter are only the points different from the play eliminating step based on time control discussed above.

The play eliminating step in this modified example applies a low driving voltage (half the normal voltage or lower) to the DC motor 221 as a voltage insufficient for rotating the platen roller 22*a* so as to slightly rotate the DC motor 221 and eliminate the play (see graph b1 in FIG. 7B).

When the play (clearance) produced by the backlash lies in the normal rotation direction under this condition, the driving force of the DC motor 221 rotates the respective gears 223, 226, and 227 in the normal rotation direction (direction for eliminating the clearance) as illustrated in a graph b2 in FIG. 7B. As a result, the tooth surfaces of the respective gears 223, 226, and 227 come into contact with each other. When increase in the rotation loads of the respective gears 223, 226, and 227 is detected by an arbitrary detection method, the DC motor 221 comes to a stop (period "A" in FIGS. 7A and 7B).

On the other hand, when the play (clearance) produced by the backlash lies in the reverse rotation direction, the low voltage applied to the DC motor 221 does not produce power sufficient for rotating the respective gears 223, 226, and 227 as illustrated in a graph b3 in FIG. 7B, and the platen roller 22*a*. In this condition, therefore, the respective gears 223, 226, and 227, and the platen roller 22*a* do not rotate.

After completion of the play eliminating step (after the elapse of the period "B" in FIGS. 7A and 7B), the DC motor 221 is rotated so as to rotate the platen roller 22*a* in the normal rotation direction for the purpose of printing (see graph b4 in FIG. 7B).

According to this method, the DC motor 221 is driven by the low voltage insufficient for rotating the platen roller 22*a*. Accordingly, the play produced by the backlash can be easily eliminated by the same control regardless of the direction of contact between the tooth surfaces of the respective gears 223, 226, and 227.

Method for Preventing Positional Deviation Caused by Cutting Resistance

According to the tape printer 1, the printing tape 32 after printing is cut by the cutter mechanism 23 during suspension of printing, and discharged through the sheet outlet 20 to the outside. During cutting of the printing tape 32 by the cutter mechanism 23, the printing tape 32 is drawn toward the cutter mechanism 23 (toward the downstream side) by a cutting resistance produced by the cutting. As a result, the platen roller 22*a* slightly rotates in the normal rotation direction by the amount corresponding to the play in the reverse rotation direction produced by the backlash of the platen side gear train 224. In this case, the thermal head 521 faces to a portion of the printing tape 32 shifted toward the upstream side from the portion thereof corresponding to the suspension. When printing is restarted for the next line printing under this condition, a linear missing part where no printing (no dots) is formed is produced between the line printed prior to the suspension and the next line.

For solving this problem, the tape printer 1 according to this embodiment controls the feed driver 22*b* so as to prevent deviation between the relative positions of the thermal head 521 and the printing tape 32 caused when the printing tape 32 is cut by the cutter mechanism 23 under the suspension of printing.

Figure 8A:
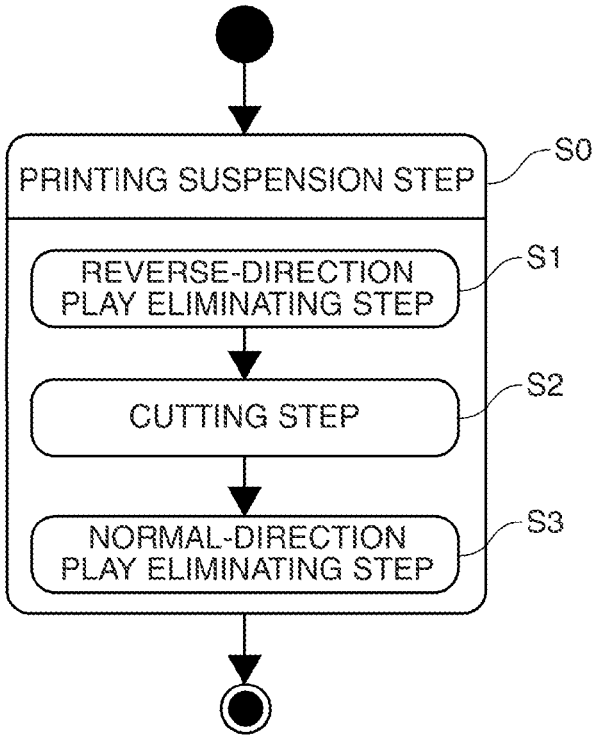
FIG. 8A is a flowchart showing a printing suspension step.

The control method for the tape printer 1 according to this embodiment is hereinafter explained with reference to FIGS. 8A and 8B. FIG. 8A is a flowchart showing a printing suspension step S0, while FIG. 8B is a graph showing the change of the number of revolutions of the DC motor 221 with time.

As can be seen from the flowchart in FIG. 8A, the control method performed by the controller of the tape printer 1, wherein the printing suspension step S0 cuts the printing tape 32 during suspension of the printing operation and restarts the suspended printing operation after completion of the cutting, includes a reverse-direction play eliminating step S1 which slightly drives the DC motor 221 in the reverse rotation direction immediately after the start of suspension of the printing operation to eliminate play in the reverse rotation direction produced by the backlash of the platen side gear train 224 without rotating the platen roller 22*a*, a cutting step S2 which drives the cutter mechanism 23 after completion of the reverse-direction play eliminating step S1 to cut the printing tape 32, and a normal-direction play eliminating step S3 which slightly drives the DC motor 221 in the normal rotation direction after completion of the cutting step S2 and immediately before restart of the printing operation to eliminate play in the normal rotation direction produced by the backlash of the platen side gear train 224 without rotating the platen roller 22*a*.

The reverse-direction play eliminating step S1 eliminates the play in the reverse rotation direction by stopping control which applies driving voltage to the DC motor 221 in the reverse rotation direction. The rotational driving of the DC motor 221 during the printing process and the reverse-direction play eliminating step S1 (stopping control) is controlled by PWM control.

Figure 8B:
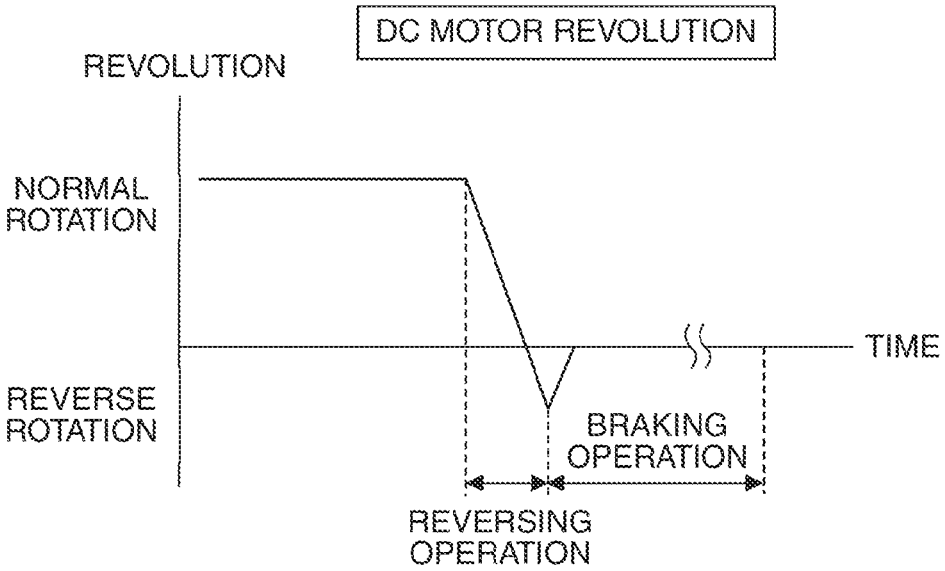
FIG. 8B is a graph showing the change of the number of revolutions of the DC motor with time.

More specifically, as illustrated in FIG. 8B, the controller of the tape printer 1 inputs a reverse rotation signal to the DC motor 221 in the normal rotation condition (during printing). In response to the inputted signal, the normal rotation speed of the DC motor 221 decreases within a short period. In accordance with this speed drop, the normal rotation speed of the platen roller 22*a* rotated via the platen side gear train 224 also decreases. The reverse rotation signal in this context refers to a signal for changing the flow direction of current to the direction opposite to the normal rotation direction.

When the reverse rotation action responding to the reverse rotation signal continues, the normal rotation of the DC motor 221 (and the rotation of the platen roller 22*a*) comes to a stop. In this condition, the tooth surfaces of the worm wheel gear 223 and the platen input gear 226 and the platen output gear 227 constituting and the platen side gear train 224 contact each other in the normal rotation direction. In other words, the backlash produces play (clearance) in the reverse rotation direction.

The controller of the tape printer 1 continues the reverse rotation action after the stop of the normal rotation of the DC motor 221 (and the platen roller 22*a*). As a result, the DC motor 221 starts reverse rotation. This reverse rotation takes place to such an extent as not to rotate the platen roller 22*a*, so as to eliminate the play in the reverse rotation direction produced by the backlash of the platen side gear train 224. The input period of the reverse rotation signal (reverse period) in this embodiment is set at 16.5 msec.

Then, the controller of the tape printer 1 inputs a brake signal to the DC motor 221. In response to this signal, the reverse rotation of the DC motor 221 stops. The brake signal in this context means a signal of so-called short brake. The braking period given in response to the brake signal is set at 100 msec. in this embodiment. The rotation of the DC motor 221 continuing until the stop in this embodiment corresponds to approximately 11 dots in the printing process performed by the thermal head 521.

In this condition, the respective gears 223, 226, and 227 have no play in the reverse rotation direction, but have play in the normal rotation direction. This condition prevents the slight rotation of the platen roller 22*a* within the range of the play in the reverse rotation caused by the subsequent cutting operation (cutting resistance) for the printing tape 32 using the cutter mechanism 23.

Then, the controller of the tape printer 1 performs the cutting step S2. In the cutting step S2, the printing tape 32 is cut, and discharged through the sheet outlet 20 (as labels).

After the cutting step S2, the controller of the tape printer 1 performs the normal-direction play eliminating step S3. By completion of this step, the respective gears 223, 226, and 227 have no play in the normal rotation direction, but have play in the reverse rotation direction, which condition prevents idling of the DC motor 221 and the platen side gear train 224 and accurately rotates the platen roller 22*a*. The procedures of the normal-direction play eliminating step S3 are similar to the corresponding procedures of the play eliminating method before the printing start (play eliminating step) or of the corresponding method in the modified example discussed above, and thus are not repeatedly explained herein.

According to this method, the reverse-direction play eliminating step S1 eliminates the play in the reverse rotation direction produced by the backlash of the platen side gear train 224 immediately after the start of suspension of the printing operation. After the cutting step S2, the normal-direction play eliminating step S3 eliminates the play in the normal rotation direction immediately before restart of the printing operation. Accordingly, this method can prevent slight rotation of the platen roller 22*a* within the range corresponding to the play in the reverse rotation direction caused by cutting the printing tape 32 using the cutter mechanism 23 during the cutting step S2. Moreover, this method can maintain preferable printing quality by preventing idling of the DC motor 221 and the platen side gear train 224 and thus accurately rotating the DC motor 221.

The control method for the tape printer 1 (printing suspension step S0) performed automatically by the controller according to this embodiment may be executed arbitrarily by the user through operation of the control terminal 18.

It should be understood that the invention is not limited to the embodiment described in the foregoing detailed description, but is susceptible to numerous modifications and variations without departing from the spirit and scope of the invention.

What is claimed is:

1. A tape printer control method comprising:

(a) performing printing operation by driving a printing head while feeding a printing tape using a feed roller to which normal rotation power of a motor is transmitted via a gear train;

(b) driving the motor slightly in a reverse rotation direction during the printing operation so as to stop normal rotation of the feed roller and eliminate play in the reverse rotation direction produced by the backlash of the gear train without rotating the feed roller in the reverse rotation direction;

(c) suspending the printing operation;

(d) performing cutting operation for the printing tape using a tape cutter on the downstream side of the printing head in the tape feed direction;

(e) driving the motor slightly in the normal rotation direction before restart of the printing operation so as to eliminate play in the normal rotation direction produced by the backlash of the gear train without rotating the feed roller; and (f) restarting the printing operation.

2. The tape printer control method according to claim 1, wherein following step (c), applying driving voltage in the reverse rotation direction to the motor so that the play in the reverse rotation direction is eliminated by plugging.

3. The tape printer control method according to claim 1, wherein in step (e), applying a driving voltage sufficient for rotating the feed roller to the motor so that the play in the normal rotation direction is eliminated by both of slight rotation of the motor in the normal rotation direction and of inertial rotation of the motor.

4. The tape printer control method according to claim 1, wherein in step (e), applying a low driving voltage insufficient for rotating the feed roller to the motor so that the play in the normal rotation direction is eliminated by slight rotation of the motor in the normal rotation direction.

5. The tape printer control method according to claim 1, wherein in (b), the motor is driven in the reverse rotation direction while the feed roller is rotating in the normal rotation direction.

6. The tape printer control method according to claim 1, wherein in (b), the motor is driven slightly in the reverse rotation direction so as to eliminate play in the normal direction produced by the backlash of the gear train without rotating either the feed roller or the gear train.

7. The tape printer control method according to claim 1, wherein in (b), the motor is driven in the reverse rotation direction for a period of greater than 10 msec.

8. A tape printer comprising:

a motor for functioning as a power source;

a feed roller configured to rotate by the power of the motor to feed a printing tape;

a gear train configured to transmit the power of the motor to the feed roller;

a printing head for performing printing on the printing tape being fed;

a tape cutter disposed on the downstream side of the printing head in the tape feed direction to cut the printing tape; and a controller for controlling the motor, the printing head, and the tape cutter, wherein, before suspension of the printing operation for allowing execution of the cutting operation for the printing tape, which cutting operation is followed by restart of the printing operation, the controller slightly drives the motor in a reverse rotation direction during the printing operation so as to stop normal rotation of the feed roller and eliminate play in the reverse rotation direction produced by the backlash of the gear train without rotating the feed roller, and slightly drives the motor in the normal rotation direction before the restart of the printing operation so as to eliminate play in the normal rotation direction produced by the backlash of the gear train without rotating the feed roller.

9. The tape printer according to claim 8, wherein the controller drives the motor by applying driving voltage in the reverse rotation direction so that the play in the reverse rotation direction is eliminated by plugging.

10. The tape printer according to claim 8, wherein the controller drives the motor by applying a driving voltage sufficient for rotating the feed roller to the motor so that the play in the normal rotation direction is eliminated by both of slight rotation of the motor in the normal rotation direction and of inertial rotation of the motor.

11. The tape printer according to claim 8, wherein the controller drives the motor by applying a low driving voltage insufficient for rotating the feed roller to the motor so that the play in the normal rotation direction is eliminated by slight rotation of the motor in the normal rotation direction.

* * * * *